US005618212A

United States Patent [19]

Moore

[11] Patent Number: 5,618,212

[45] Date of Patent: Apr. 8, 1997

[54] TROLLING MOTOR FOOT PEDAL ASSEMBLY

[75] Inventor: Prentice Moore, Starkville, Miss.

[73] Assignee: Brunswick Corporation, Lake Forest, Ill.

[21] Appl. No.: 426,161

[22] Filed: Apr. 21, 1995

[51] Int. Cl.[6] ..... B63H 21/17

[52] U.S. Cl. ..... 440/7; 200/303; 200/333; 200/512; 220/787

[58] Field of Search ..... 114/144 A; 440/6, 440/7, 84; 220/307, 308; 200/333, 303, 295, 512; 318/16

[56] References Cited

U.S. PATENT DOCUMENTS 3,121,415 2/1964 Anderson et al. ..... 440/87
3,156,515 11/1964 More ..... 220/307
4,128,744 12/1978 Seeger ..... 200/512
5,193,669 3/1993 Demeo et al. ..... 200/512

*Primary Examiner*—Sherman Basinger
*Attorney, Agent, or Firm*—Rosenblatt & Redano P.C.

[57] ABSTRACT

A remote-control, foot-operated unit for use with trolling motors on boats is revealed. The unit has a snap-together design that does not use screw fasteners extending through holes. As a result, the sensitive electronic components are completely sealed from contact with any water or water vapor. The snap design has a back-up feature to prevent accidental snap-release in the event of shock loading. The assembly fits together as a sandwich, effectively positioning a sealing component in juxtaposition with the snap arrangements to promote a secure connection around the periphery of the unit, as well as a tight sealing engagement between the sandwich components to, in effect, isolate the sensitive electronic components from exposure to any moisture.

21 Claims, 2 Drawing Sheets

TROLLING MOTOR FOOT PEDAL ASSEMBLY

FIELD OF THE INVENTION

The field of this invention relates to housings for control systems, preferably used in control of trolling motors for boats. More particularly, the field of the invention relates to fastener assemblies for such structures.

BACKGROUND OF THE INVENTION

Fishing boats typically have a main inboard or outboard motor to rapidly position the boat in a particular portion of a body of water so that a fisherman can begin fishing. These boats typically also come with a far smaller trolling motor which allows the boat to be maneuvered in a smaller area while the fisherman is fishing. Many different controls have been provided in the past for trolling motors. In the past, the most common form of control over the trolling motor has required the fisherman or another person in the boat to physically manipulate the motorhead once the trolling motor has been swung from the boat to position its propeller in the water. Thus, changes in direction of the boat are effected by rotation of the trolling motor around a horizontal plane while the speed may also be regulated as well as the direction of movement, with controls C generally locally mounted adjacent the motorhead M, as shown schematically in FIG. 1. More recently, technology has found its way into control systems for trolling motors, with the result that the trolling motor can now be remotely actuated to do all the same maneuvers as previously described from different positions in the boat using a remote panel. Typically, these panels work on radio frequency communication between the trolling motor head and the control panel. Other over-the-air communication techniques can also be used.

Since these control panels are primarily foot-operated, they need to be placed, when used on the bottom of the boat, in a location accessible to the operator's foot. This means that they need to be handled to be placed in the desired position and could be subjected to shock loads from being occasionally dropped. Since these control units require electronic components, they must be constructed in such a manner to be sufficiently rigid to withstand shock loading which occasionally occurs. They must also be built such that the electronic components are sealed against the invasion of water or moisture which can be found along the bottom of boats. Finally, another desirable feature of such remote-actuation units is that they be lightweight and easily assembled and maintain their assembled condition despite the uses typically encountered during boating operations. These desirable objectives have been incorporated into the apparatus of the present invention as will be described below. With these improvements, a remote-control, foot-operated unit can be fabricated simply and economically and be readily assembled. Once assembled, it can prove to be durable and reliable in its mechanical integrity as well as an effective housing for the sensitive electronic components, keeping them protected from water vapor or moisture which can detrimentally affect their operation. Screws or other similar fasteners which must extend through seals are completely eliminated. As a result, this invention has overcome some of the prior design weaknesses which heighten the risk of migration of water vapor or other liquids into sensitive electronic components.

SUMMARY OF THE INVENTION

A remote-control, foot-operated unit for use with trolling motors on boats is revealed. The unit has a snap-together design that does not use screw fasteners extending through holes. As a result, the sensitive electronic components are completely sealed from contact with any water or water vapor. The snap design has a back-up feature to prevent accidental snap-release in the event of shock loading. The assembly fits together as a sandwich, effectively positioning a sealing component in juxtaposition with the snap arrangements to promote a secure connection around the periphery of the unit, as well as a tight sealing engagement between the sandwich components to, in effect, isolate the sensitive electronic components from exposure to any moisture.

DETAILED DESCRIPTION OF THE PREFERRED EMBODIMENT

Figure 1:
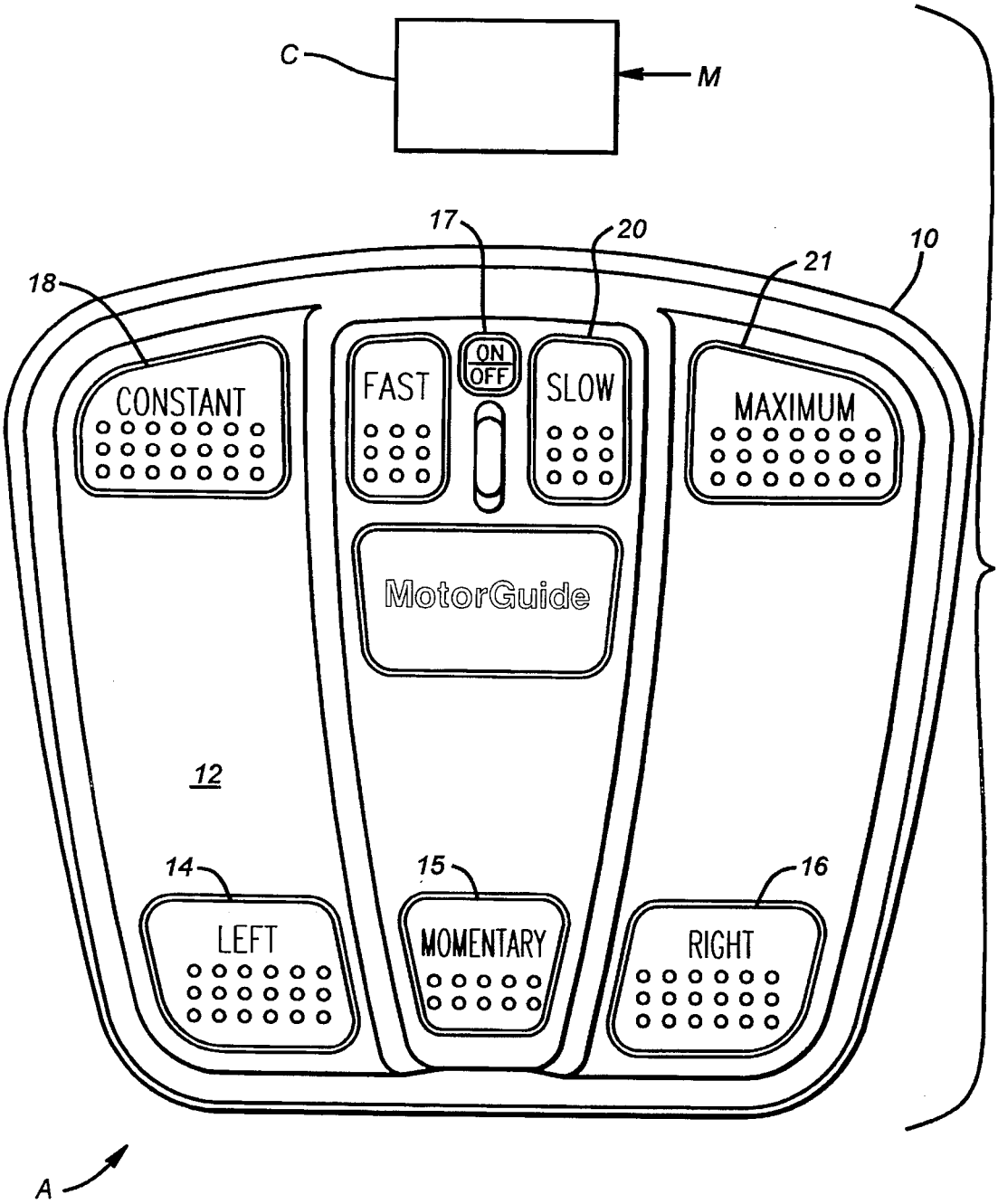
FIG. 1 is a plan view of the remote-control unit.
Figure 2:
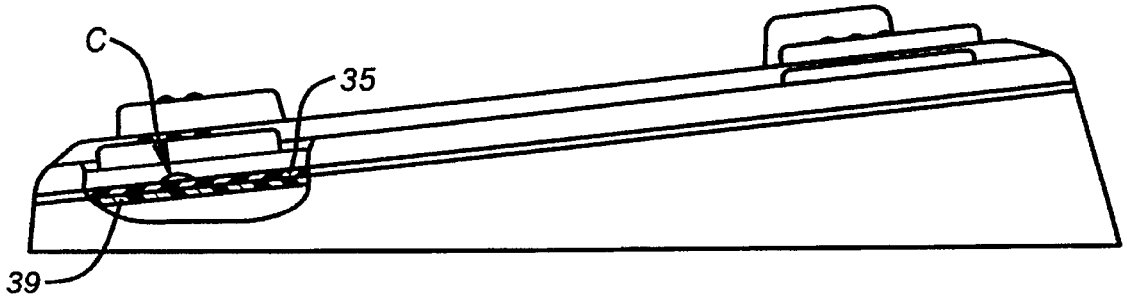
FIG. 2 is the unit of FIG. 1, shown in a side elevational view.

The apparatus A is shown in FIGS. 1 and 2. A base 10 is a portable construction, suitable for placement in the bottom of the boat so that a series of switches located in the cover 12 can be operated with the foot. These switches can, in one form, be membrane switches. The direction of the trolling motor can be changed using switches 14–16. The trolling motor can be turned on or off with switch 17, while the speed of the trolling motor can be controlled with switches 18–21. The switches and their functions are clearly labeled in FIG. 1. These switches or buttons such as 14–16, when depressed bear against pad 35 which in turn is forced against switchboard 39 to initiate the closure of an electrical connection C to initiate the particular action required. The base 10 has a plurality of snaps disposed around its periphery, with a typical snap shown in FIG. 3.

Figure 3:
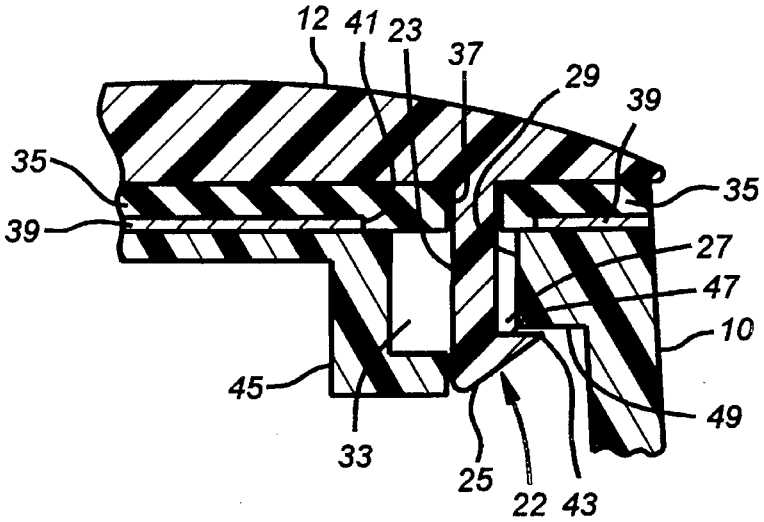
FIG. 3 is a section through the unit, showing how the snap system operates around the periphery of the unit.

As shown in FIG. 3, the face or cover 12 has a snap 22 which is generally an L-shape with a downwardly extending segment 23 and a transverse segment 25. The transverse segment may be tapered, as shown in FIG. 3. The snap 22 forms an L-shaped grip 27 which is formed to fit around "projection" 29 of base 10. The edge of cut-out 33 serves as the "projection" 29. Base 10 has a cut-out 33 through which extends extending segment 23. Those skilled in the art will appreciate that the view of FIG. 3 is after the snap 22 has been fully snapped into place to secure the face or cover 12 to the base 10.

In between the cover 12 and the base 10 is a continuous, soft, sealing pad 35, preferably made of a flexible impervious material such as rubber. The extending segment 23 goes through pre-formed openings 37 in the pad 35 so that when the snap 22 is placed in the position shown in FIG. 3, a downward force is exerted by the face or cover 12 onto pad 35, which in turn covers the membrane switch board 39. Membrane switch board 39 is a flat board containing electronic circuitry which has a pre-formed opening 41 in general alignment with cut-out 33 on base 10, but somewhat larger such that the pad 35 spans over opening 41, effectively keeping it sealingly isolated from cut-out 33. As a result, due to the vertical sealing force exerted downwardly on pad 35 when snap 22 is made up to projection 29, the membrane switch board 39 with its sensitive electronic circuitry is sealingly isolated from any water vapors or water that may be pooled up on the floor of the boat. The migration of water or water vapor onto the membrane switch board 39 can adversely affect its operation by creating corrosion or rust which may initially, or after some extended exposure, lead to short circuits and failure of the control unit of the apparatus A to operate.

In order to ensure the sealing integrity of the pad 35 over the membrane switch board 39, the assembly of the snap 22 as shown in FIG. 3 is disposed around the periphery of the base 10 to secure around that periphery the sealing relationship just described. The spacing of snaps 22 and their individual width can be varied, all within the scope of the invention. Clearly, the closer the spacing and the longer the width of each individual snap, the more force is applied to the pad 5, sandwiching the membrane switch board 39 against the base 10 while at the same time enveloping its periphery and any openings 41 from access to moisture such as near cut-out 33.

Each of the snaps 22 has a point 43 which is deflected by projection 29 in order to insert the extending segment 23 into cut-out 33. The rearward deflection of snap 22 toward support 45 occurs immediately upon insertion of the snap 22 into cut-out 33. As the cover 12 is further brought down, point 43 rides along projection 29 until the lower end 25 with the taper engages the L-shaped snap support 45. Although the preferred embodiment of snap support 45 is an L-shape, other shapes that serve the same function can be substituted without departing from the spirit of the invention. It can readily be seen that snap support 45 is a cantilevered structure that is unitary to the base 10 and extends into the pathway of snap 22 as it descends with point 43 riding on projection 29. In order to complete the snap procedure and put the snap 22 in the position shown in FIG. 3, an additional force must be applied to the cover 12 as the lower segment 25 reaches and contacts the L-shaped snap support 45. When this occurs, an additional force is provided by the fisherman or the assembler of the apparatus A, which results in a deflection of snap support 45 out of the way. This is generally accomplished by a combination of lateral and rotational movement of snap support 45 as the lower segment 25 of the snap 22 bears down on it responsive to force applied to the cover 12. Once the snap support 45 is pushed sufficiently out of the way, further downward advancement of point 43 of snap 22 can occur along the face of projection 29. Eventually, point 43 clears the lower end of projection 29. At that point there is nothing to hold back snap support 45 and it springs back to its original shape, as shown in FIG. 3. This springing back action also promotes the natural tendency of snap 22 to spring back to its original position once point 43 clears the lower portion of projection 29. Accordingly, both components, snap 22 and snap support 5, flex back to their neutral positions when point 43 clears projection 29 to assume the positions shown in FIG. 3. With that position assumed, shock loads, whether encountered at base 10 or at cover 12, will not make snap 22 release its grip on projection 29. The snap support 45 provides a stiff back-up to the lower end 25 of snap 22 to keep its L-shaped gripping surfaces 27 in close gripping contact with projection 29. While it is understood that there may be some looseness in the fit between surfaces 27 and projection 29, any such looseness that may be present should be in the lateral direction only within the cut-out 33. The horizontal component 47 should have a firm grip on the underside 49 of the projection 29. This firm grip is significant so that the pad 35 has a sufficient force against the base 10 to effectively seal any moisture or water from the membrane switch board 39.

Those skilled in the art can appreciate that the snap 22 can be undone if the snap support 45 is manipulated rearwardly so that the snap 22 can be manipulated rearwardly as well to clear the projection 29 with point 43. The apparatus A contemplates periodic disassembly for any service of the membrane switch board 39 or for replacement of any power supply such as batteries or other sources (not shown).

Those skilled in the art will appreciate that FIG. 3 is a section view of one such snap assembly, with the snap assemblies in the preferred embodiment being distributed about the periphery of the entire apparatus A. The assembly as described provides a fast and secure way without screws or other difficult to readily assemble types of fasteners that require holes and significantly more labor. Here, a simple four-pail assembly is immediately put together without the use of any skilled labor and it provides a safe and reliable sealing arrangement for the membrane switch board 39. It also stays together under the typical shock loads that may be expected when the apparatus A is occasionally dropped by accident to the bottom of the boat. Apart from being easy to assemble, the apparatus A also provides a way for rapid disassembly should there be any need for maintenance or replenishment of the power source. The power source may also be included within the cover 12 to keep it sealingly isolated from exposure to any moisture through the use of the pad 35.

It can readily be seen from FIG. 3 that the opening in the membrane switch board 39 is larger than the opening defining cut-out 33. The pad 35 extends downwardly against the base 10, circumscribing the opening defining cutout 33 to, in effect, sealingly isolate the membrane switch board 39 from exposure to any liquids or vapors that come into cut-out 33. The L-shaped snap support 45 may be immediately adjacent or in contact with the snap 22 when fully assembled, as shown in FIG. 3. In order to maintain the integrity of the joint, the horizontal component 47 should engagingly grip the underside 49 of base 10. The L-shaped snap support 45 can be manually snapped back to facilitate release of the cover 12 from the base 10. Those skilled in the art will appreciate that the pails can be transposed as between the base 10 and the cover 12 insofar as they relate to the action of the snap 22, all without departing from the spirit of the invention.

The foregoing disclosure and description of the invention are illustrative and explanatory thereof, and various changes in the size, shape and materials, as well as in the details of the illustrated construction, may be made without departing from the spirit of the invention.

I claim:

1. In combination, a trolling motor having a motorhead therewith and a snap for securing a cover to a base for a trolling motor control assembly, said control assembly comprising:

a base having at least one catch thereon, said base including electronics used to operate said trolling motor through said motorhead;

a cover having at least one flexible extending member to selectively engage said catch in a gripping manner;

a sealing member between said base and said cover, said extending member passing through said sealing member to engage said catch;

a snap support acting on said extending member when engaged to said catch to assist in maintaining said engagement.

2. The combination of claim 1, wherein:

said extending member is in an interference fit with said catch when said cover is mounted to said base, requiring said extending member to flex in order to advance with respect to said catch.

3. The combination of claim 2, wherein:

said snap support is in an interference fit with said extending member as said extending member is advanced with respect to said catch.

4. The combination of claim 3, wherein:

said snap support is a flexible cantilevered member;

whereupon when said extending member clears said catch, said cantilevered member urges said extending member against said catch in an engaging manner.

5. The combination of claim 4, wherein:

said cantilevered member is supported by said base opposite an opening in said base which defines said catch;

said extending member comprises a cantilevered flexible structure having a projection thereon and extending from said cover;

whereupon assembly, said extending member is deflected upon entry into said opening and further deflects said snap support away from said catch until said projection clears said catch, whereupon said projection snaps under said catch with said snap support further snapping toward said catch in tandem to secure the engagement.

6. The combination of claim 5, wherein:

said extending member comprises an L-shape where one leg of said L-shape grabs the underside of said catch to secure the engagement;

said snap support comprises an L-shape;

whereupon completion of the attachment of said base to said cover, said L-shapes are in substantially parallel alignment.

7. The combination of claim 6, wherein:

said L-shapes are also in contact upon completion of the attachment.

8. The combination of claim 7, further comprising:

a plurality of said extending members and said snap supports distributed about the periphery of said base and said cover.

9. A snap for securing a cover to a base, comprising:

a base having a catch thereon;

a cover having a flexible extending member to selectively engage said catch in a gripping manner;

a snap support acting on said extending member when engaged to said catch to assist in maintaining said engagement;

said extending member is in an interference fit with said catch when said cover is mounted to said base, requiring said extending member to flex in order to advance with respect to said catch;

said snap support is in an interference fit with said extending member as said extending member is advanced with respect to said catch;

said snap support is a flexible cantilevered member;

whereupon when said extending member clears said catch, said cantilevered member urges said extending member against said catch in an engaging manner;

said cantilevered member is supported by said base opposite an opening in said base which defines said catch;

said extending member comprises a cantilevered flexible structure having a projection thereon and extending from said cover;

whereupon assembly, said extending member is deflected upon entry into said opening and further deflects said snap support away from said catch until said projection clears said catch, whereupon said projection snaps under said catch with said snap support further snapping toward said catch in tandem to secure the engagement;

said extending member comprises an L-shape where one leg of said L-shape grabs the underside of said catch to secure the engagement;

said snap support comprises an L-shape;

whereupon completion of the attachment of said base to said cover, said L-shapes are in substantially parallel alignment;

said L-shapes are also in contact upon completion of the attachment;

a plurality of said extending members and said snap supports distributed about the periphery of said base and said cover;

a sealing member generally conforming to the shapes of said base and said cover, having an opening in alignment with said flexible extending member;

a switch member generally conforming to the shape of said base and said cover, and having an opening in alignment with said extending member and said opening in said base;

whereupon assembly of said cover to said base with said sealing member and said switch member in between, said switch member is sealingly isolated from said opening in said base by said sealing member.

10. In combination, a trolling motor and a control unit for remote control of the trolling motor, said control unit comprising:

a portable base having at least one catch thereon;

a cover having at least one extending member which forms a snap thereon;

a switch member, said switch member operable to control said trolling motor;

a sealing member;

said base and said cover selectively engageable by virtue of said extending member extending through said sealing member and through an aligned opening in said base to engage said catch on said base to create a stack which sealingly secures said switch member between said cover and said base, including around said opening in said base, by virtue of said sealing member.

11. A control unit for remote control of a trolling motor, comprising;

a base;

a cover;

a switch member;

a sealing member;

said base and said cover selectively engageable to create a stack which sealingly secures said switch member between said cover and said base by virtue of said sealing member;

said base comprises at lust one opening therethrough;

said switch member having at least one larger opening than the opening in said base;

whereupon when said switch member is aligned with said base for assembly, said scaling member, when interposed adjacent said base, has at least one opening thereon to allow it to circumscribe the opening in said base to effectively isolate said switch member from exposure to the opening in said base.

12. The unit of claim 11, further comprising:

at least one actuating member extending through said cover and movable against said sealing member, said actuating member operating a circuit on said switch member due to its deflection into said sealing member.

13. The unit of claim 11, wherein:

said switch member is sealing sandwiched between said base and said cover by virtue of said sealing member and held together by a snap assembly disposed at intervals on the periphery of said base and said cover.

14. The unit of claim 11, wherein:

said base is formed having a catch thereon;

said cover formed having a snap assembly comprising a flexible extending member to selectively engage said catch in a gripping manner; and a snap support acting on said extending member when engaged to said catch to assist in maintaining said engagement.

15. The unit of claim 14, wherein:

said extending member is in an interference fit with said catch when said cover is mounted to said base, requiring said extending member to flex in order to advance with respect to said catch.

16. The unit of claim 15, wherein:

said snap support is in an interference fit with said extending member as said extending member is advanced with respect to said catch.

17. The unit claim 16, wherein:

said snap support is a flexible cantilevered member;

whereupon when said extending member clears said catch, said cantilevered member urges said extending member against said catch in an engaging manner.

18. The unit of claim 17, wherein:

said cantilevered member is supported by said base opposite an opening in said base which defines said catch;

said extending member comprises a cantilevered flexible structure having a projection thereon and extending from said cover;

whereupon assembly, said extending member is deflected upon entry into said opening and further deflects said snap support away from said catch until said projection clears said catch, whereupon said projection snaps under said catch with said snap support further snapping toward said catch in tandem to secure the engagement.

19. The unit of claim 18, wherein:

said extending member comprises an L-shape where one leg of said L-shape grabs the underside of said catch to secure the engagement;

said snap support comprises an L-shape;

whereupon completion of the attachment of said base to said cover, said L-shapes are in substantially parallel alignment.

20. The unit of claim 19, wherein:

said L-shapes are also in contact upon completion of the attachment.

21. The unit of claim 20, further comprising:

a plurality of said extending members and said snap supports distributed about the periphery of said base and said cover.

* * * * *